US006089702A

United States Patent [19]

Hilton

[11] Patent Number: 6,089,702

[45] Date of Patent: Jul. 18, 2000

[54] METHOD AND APPARATUS FOR DEGASSING INK UTILIZING MICROWAVES

[75] Inventor: Brian S. Hilton, Rochester, N.Y.

[73] Assignee: Xerox Corporation, Stamford, Conn.

[21] Appl. No.: 09/234,106

[22] Filed: Jan. 19, 1999

[51] Int. Cl.[7] ..... B41J 2/19

[52] U.S. Cl. ..... 347/92

[58] Field of Search ..... 347/92, 102, 85

[56] References Cited

U.S. PATENT DOCUMENTS

| | | | |
|---|---|---|---|
| 4,460,904 | 7/1984 | Oszczakiewicz et al. | 347/89 |
| 5,220,346 | 6/1993 | Carreira et al. | 347/102 |
| 5,341,162 | 8/1994 | Hermanson et al. | 347/92 |
| 5,410,283 | 4/1995 | Gooray et al. | 333/159 |
| 5,422,463 | 6/1995 | Gooray et al. | 219/694 |
| 5,631,685 | 5/1997 | Gooray et al. | 347/102 |
| 5,691,753 | 11/1997 | Hilton | 347/85 |

*Primary Examiner*—N. Le
*Assistant Examiner*—Michael Nghiem
*Attorney, Agent, or Firm*—Oliff & Berridge, PLC

[57] ABSTRACT

An apparatus and method for degassing liquid ink utilizes microwaves. An ink degassing unit includes a microwave heater that heats the liquid ink in an ink line passing through the microwave heater. The liquid ink is heated to supersaturate the ink with air and a vacuum chamber of the ink degassing unit is disposed along the ink line and evacuates the ink to pull the air out of the ink. A control system selectively couples the ink degassing unit onto one or more of a plurality of ink supply lines so that only supply lines of ink currently being used for printing are degassed. The control system selectively diverts at least one ink supply line connected to a printhead through the ink degassing unit.

17 Claims, 4 Drawing Sheets

METHOD AND APPARATUS FOR DEGASSING INK UTILIZING MICROWAVES

BACKGROUND OF THE INVENTION

1. Field of Invention

This invention is related to degassing liquid ink. More particularly, this invention is directed to degassing liquid ink using microwaves.

2. Description of Related Art

Thermal ink jet printers have a plurality of thermal ink ejectors for ejecting ink onto a recording medium, such as, for example, paper. Each thermal ink ejector has a resistor to selectively vaporize ink near the nozzle of a capillary filled ink channel. The vaporized ink forms a bubble that temporarily expels an ink droplet and propels it toward the recording medium. However, air can be forced out of the ink when heating the ink. Air pockets collect in the channels, blocking refill and causing print defects.

SUMMARY OF THE INVENTION

Degassing the ink has been shown not only to prevent air pockets from forming, but in some cases, the degassed ink even reabsorbs existing pockets.

Degassing the ink at the manufacturing source causes ink handling and packaging problems. To maintain the ink in its degassed state, the ink must be packaged in air-tight packaging, which adds to the manufacturing cost and time. Also, previously tried methods of in-line degassing, such as ultrasonic degassers and thermal degassers, were either too slow, or too expensive, or both.

This present invention provides systems and methods for degassing liquid ink utilizing microwaves. The liquid ink is heated with microwaves to supersaturate the ink with air. The liquid ink is then evacuated to pull the air out of the liquid ink.

In one exemplary embodiment of the systems and methods of this invention, the liquid ink is heated using a microwave dryer and is then evacuated in a vacuum chamber. The systems and methods of this invention may be provided at the manufacturing source, but can also be provided in an ink handling system of a printer. That is, the ink line of the system is run through the microwave dryer and vacuum chamber. The printer may be, for example, an ink jet printer or any other type of printer in which degassing liquid ink is advantageous. The ink handling system may utilize the match load of a microwave dryer, where the microwave dryer is provided in the printer for drying a recording medium onto which the liquid ink has been ejected.

BRIEF DESCRIPTION OF THE DRAWINGS

Various exemplary preferred embodiments of the systems and methods of this invention will be described in detail, with reference to the accompanying figures, in which.

DETAILED DESCRIPTION OF PREFERRED EMBODIMENTS

Figure 1:
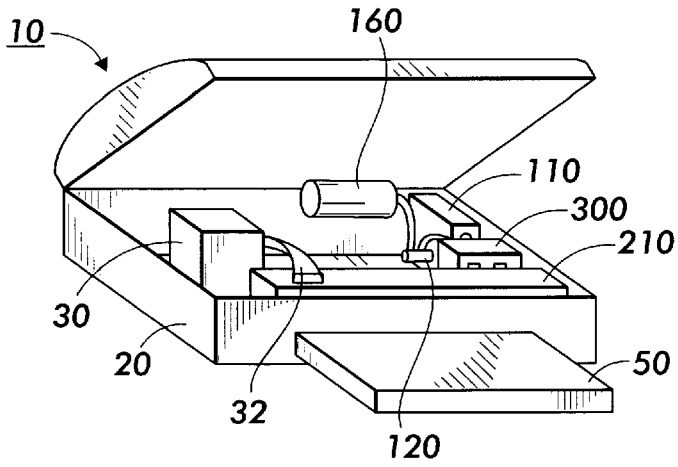
FIG. 1 is a representation of an ink jet printer containing an exemplary embodiment of an ink degasser according to this invention.

FIG. 1 is a perspective view of an ink jet printer 10. A recording medium 14 is loaded into a paper tray 50, which is inserted into a printer case 20. The recording medium moves past a thermal print head or printbar 210, which jets ink onto the recording medium in response to signals from the controller 30 via a ribbon connector 32. The ink jet printer 10 shown in FIG. 1 is a pagewidth-type printer. It should be appreciated that the ink degasser of this invention can also be incorporated into a carriage-type printer, or any other known or later developed type of printer, plotter or system in which ink degassing would be advantageous.

Figure 2:
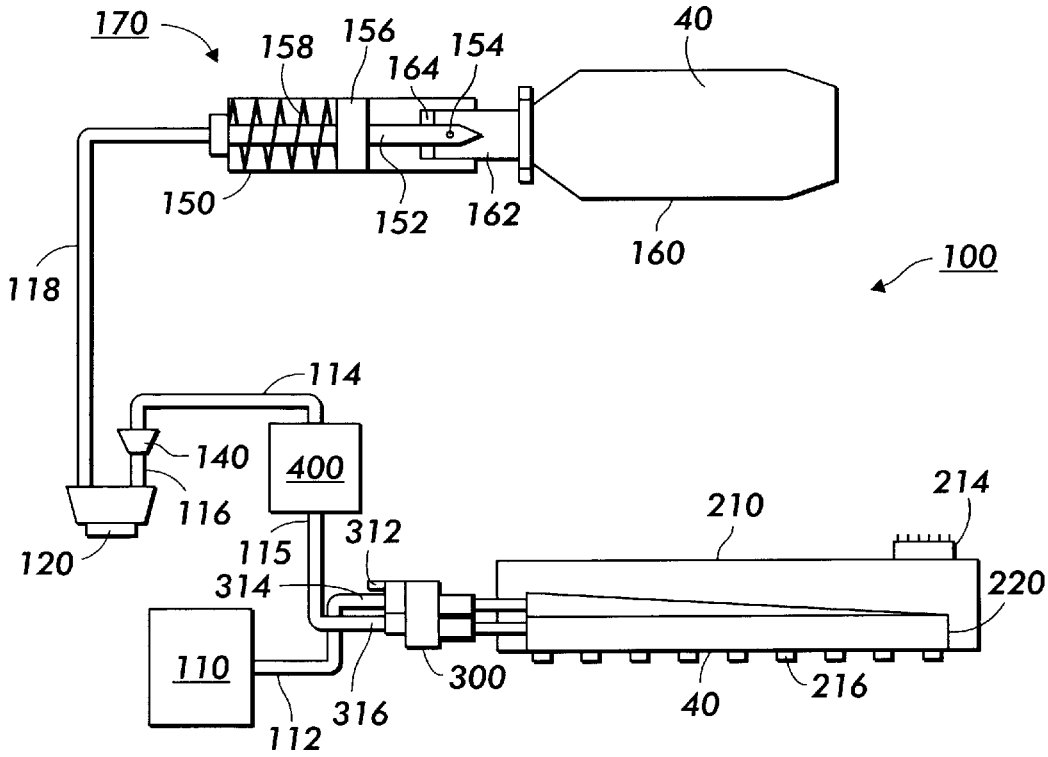
FIG. 2 is a detailed diagram of the ink handling system including the exemplary embodiment of the degasser according to this invention.

FIG. 2 is a plan view of an ink handling system 100 according to this invention for a ink jet printer. Ink is stored in an ink supply 160, which is located above, i.e., at a higher level than the position of the printbar 210. A diaphragm valve 120 controls the amount of ink flowing from the ink supply 160 to a valving connector 300. A vacuum pump 110 is connected directly to the valving connector 300. Ink is added and removed from the printbar 210 using the valving connector 300.

The ink handling system 100 delivers ink to the printbar 210 on demand. The ink handling system 100 could include a customer replaceable ink supply (not shown) and a spillage drain (not shown) for the printbar manifold 220 to aid a technician when replacing the printbar 210. Ink flow is initiated and maintained by the ink jet capillary forces, atmospheric pressure and gravity. The ink handling system 100 is duplicated for each color of a multi-color printing device.

The ink supply 160 contains ink 40, and includes a dispensing cap 162 that is connected to the ink supply 160. Because the ink 40 is degassed by the ink handling system 100, as will be discussed later, it is not necessary that the ink 40 in the ink supply 160 be degassed at the manufacturing source, or that the ink supply 160 necessarily have low permeability to moisture and air. The dispensing cap 162 contains a soft rubber septum 164, which provides an airtight seal that can be punctured with a needle 152 for easy ink removal. The septum 164 reseals itself after the needle 152 is removed to prevent the ink from spilling from the ink supply 160. The septum 164 can have, for example, a teflon layer (not shown) for low permeability to control the ink level.

The needle assembly 170 has a fixed needle 152 encased in a plastic column 150. The hollow needle 152 is sized for minimal pressure drop and has a side needle inlet 154. The combination of a side needle inlet 154 and a rounded tip prevents coring of the soft rubber septum 164, which is part of the ink bag 160. An elastomer valve 156 has a molded inner diameter optimized for minimum friction on the needle. A spring 158 positions the elastomer valve 156 to cover the needle inlet 154 when the ink bag is removed and/or replaced.

The ink supply 160 is located at a higher elevation than the printbar 210 so that the ink 40 flows toward the ink jet printer 210 via gravity. However, the printbar 210 will weep unless it has a slightly negative pressure at the printhead. Therefore, the ink line 118 is attached between the elastomer valve 156 and a diaphragm valve 120, which regulates the ink supplied to the manifold based on the pressure in the printbar.

However, it should be appreciated that any known or later developed ink supply apparatus may be attached to the ink supply line 118. That is, the specifics of the ink supply apparatus disclosed herein are not critical to the invention and may be modified and/or substitute with any known or later developed ink supply apparatus as desired by the designer or user of the particular system.

The diaphragm valve 120 provides a shut-off for the ink handling system and provides the necessary negative pressure when the printbar 210 is not in use. During printing, negative pressure produced by firing the jets creates a pressure differential across the diaphragm actuating the diaphragm valve 120 to initiate the flow of ink.

An ink line 116 connects the diaphragm valve 120 to a filter 140. The filter 140 is sized for low impedance and to prevent particles above 10 $\mu$m in size from entering the printbar manifold 220.

An ink line 114 connects the filter 140 to a microwave degassing unit 400 according to this invention. The microwave degassing unit 400 includes both a microwave dryer, which degasses the ink 40 using microwaves, and a vacuum chamber, which evacuates the ink 40. Inks specially formulated to be heated by microwaves arc known and preferred. Further, the dryer is configured such that the electrical field produced by the microwaves heat the ink 40 without damaging the ink 40.

An ink line 115 connects the microwave degassing unit 400 to a valving connector 300. The valving connector 300 provides a shut off for the ink handling system during printbar installation or removal. The valving connector 300 has three inlet lines, an air connector 312, a vacuum connector 314, and an ink connector 316. A vacuum pump 110 creates a vacuum in a vacuum line 112 which is connected to the vacuum connector 314. The vacuum allows the ink 40 to be purged from the printbar manifold 220 before the printbar 210 is removed. The valving connector 300 is connected directly to the printbar manifold 220. A controller connector 214 receives signals from a controller (not shown) to control firing the ink jets 216. In the printbar manifold 220, the level of the ink 40 remains constant during normal printing operations.

Because the ink supply 160 is located at a higher elevation than the printbar 210, the ink 40 flows toward the printbar 210 via gravity through ink line 118 to the diaphragm valve 120. The ink 40 flows from the diaphragm valve 120 through the ink line 116 toward the filter 140. The filter 140 filters out particles above 10 $\mu$m in size.

The filtered ink 40 then flows through the ink line 114 toward the microwave degassing unit 400. The microwave dryer heats the ink 40 so that it becomes supersaturated with air. The vacuum placed on the ink 40 in the vacuum chamber pulls the air out of the ink 40. The degassed ink 40 then flows through the ink line 115 through the valving connector 300 to the printbar 210.

Figure 3:
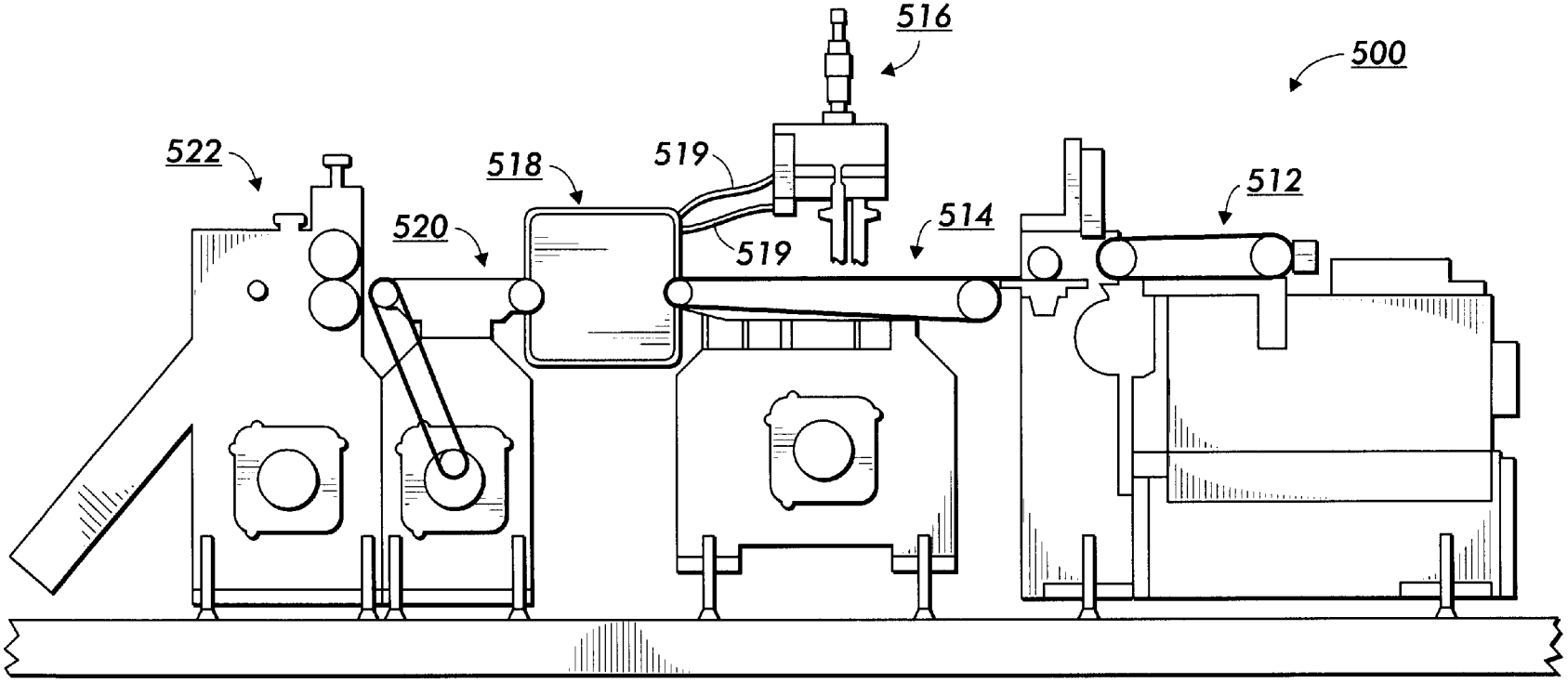
FIG. 3 is a representation of another ink jet printer including the exemplary embodiment of the degasser according to this invention.

FIG. 3 illustrates another exemplary ink jet printer 500. In the printer 500 shown in FIG. 3, the matched load of a microwave dryer, which is provided in the printer 500 for drying a recording medium onto which the ink 40 is ejected, is used to degass the ink 40 prior to ejection onto a recording medium.

The ink jet printer 500 shown in FIG. 3 includes a vacuum feed 512, which feeds the recording medium to the print transport 514. A printhead 516 deposits the ink 40 on the recording medium and may comprise a plurality of print heads. The recording medium is then transported into a waveguide microwave dryer 518, where the drying process occurs. After the ink 40 is dried, the recording medium is fed to a post dryer transporter 520 and then exits via offset rollers 522. The precise configuration of the printer is not critical to the microwave degassing systems and methods according to this invention, which are directed to degassing the ink prior to its ejection by the printhead onto the recording medium.

Figure 4:
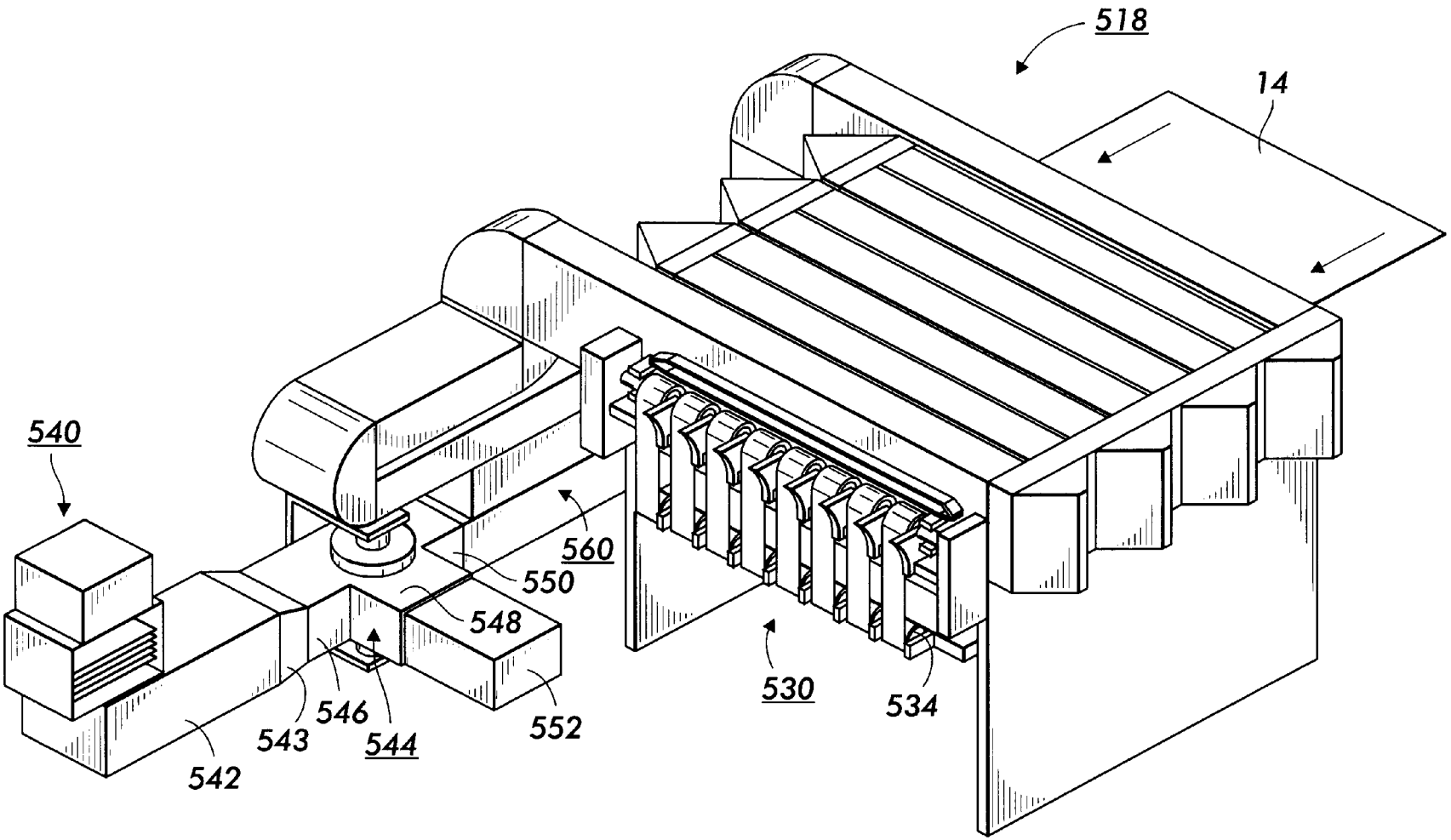
FIG. 4 is a perspective view of a microwave dryer for use in a printer of the type shown in FIG. 3.

FIG. 4 shows an example of a microwave dryer 518. The microwave dryer 518 comprises a traveling wave resonator (not shown) which enhances the field intensity to which the paper is exposed. By using the traveling wave resonator, the electric field intensity sufficient to dry ink effectively is possible with a relatively low power (less than 1.5 kW) magnetron. In addition, because traveling waves are used, uniformity of heating is much better than if standing waves are used and the applicator is not greatly affected by differences in the load or the paper and the amount of ink coverage.

The paper transport mechanism 530 moves paper through the microwave dryer 518 by a belt, or a plurality of belts, carried by the rollers 534. The microwave dryer 518 includes a microwave generator 540 for generating microwaves. The microwave generator 540 includes a 2455 MHz fixed-frequency magnetron and a magnetron power supply, as is understood by one skilled in the art. Such magnetrons are commonly used in household microwave oven applications and are available from several manufacturers at low cost. A magnetron generator with a power in the range of approximately 500–1500 watts is preferably used to generate the microwaves.

The microwave generator 540 is connected to a waveguide launcher 542. The waveguide launcher 542 is a mount for the magnetron that allows the magnetron to radiate efficiently into a waveguide. The waveguide launcher 542 includes a transition section 543. The transition section 543 connects the output of the launcher 542 to a circulator 544 having a first port 546, a second port 548 and a third port or main waveguide feed 550. The second port 548 is coupled to a matched load 552.

The circulator 544 is used to ensure stable operation of the magnetron under the operating conditions. The circulator 544 is preferably a non-reciprocal fertile device that allows power to flow from the microwave generator 540 to a microwave applicator. The matched load 552 absorbs reflected power to protect the magnetron 540 from damage. The matched load 552 includes a tuning screw (not shown) to permit fine tuning of the circuit to have a termination Voltage Standing Wave Ratio (VSWR) of less than 1.02.

A branch guide directional coupler 560 is connected to the main waveguide feed 550. The directional coupler 560 comprises a main waveguide 562. The main waveguide 562 has a first arm 572. A matching termination or matched load 580 is coupled to the first arm 572 to terminate the first arm 572. The structure and operation of the microwave dryer 518 is fully described in U.S. Pat. Nos. 5,410,283, 5,422,463 and 5,631,685, each of which is incorporated herein by reference in its entirety. As the actual structure and operation of the microwave dryer, except as outlined herein, provides no part of this invention, a further description of the structure and operation of the microwave dryer is omitted. It should further be appreciated that any other known or later developed microwave dryer, so long as it uses a matched load or the equivalent and/or has waste microwave energy available, can be used in place of the microwave dryer 518.

Figure 5:
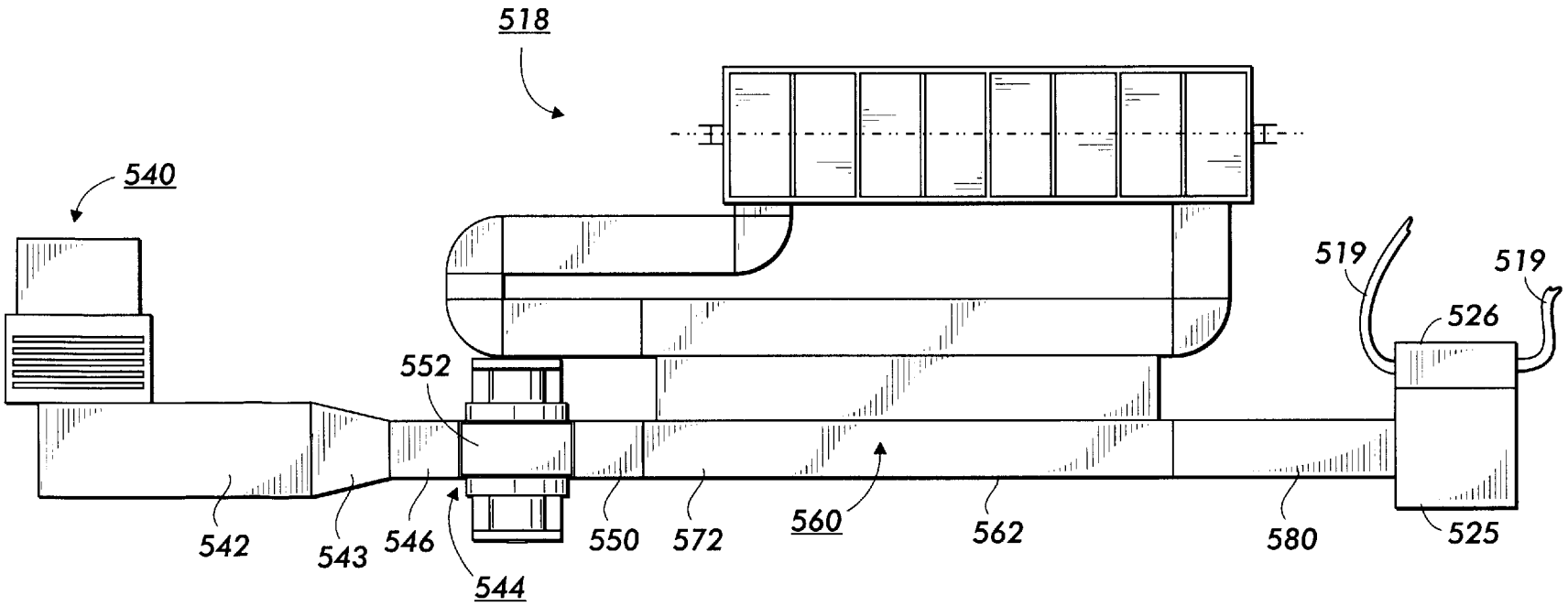
FIG. 5 is a side elevational view of the microwave dryer of FIG. 4.

As shown in FIG. 5, an ink line 519 of the printhead 516 is diverted to the microwave dryer 518. An extra microwave dryer wave guide 525 is coupled to the matching termination 580. The microwaves energy adsorbed by the ink is thus the left-over microwaves that would be wasted at the matched load 580. Therefore, less energy is needed to cool the matched load.

A control unit 526 selectively diverts the ink line 519 or portions of the ink line 519 into the wave guide 525 and removes the ink line 519 from the waveguide 525. For example, in a multiple color ink jet printer, when only selected colored inks are being used to form an image at any particular time, the control unit 526 selectively diverts only those portions of the ink line 519 into the wave guide 525 containing the selected colored ink that is currently being consumed. This ensures that only the ink that is being utilized for printing is degassed on its way to the printhead.

Besides the known major improvements in jetting reliability with degassed ink, jetting hot ink has other advantages. That is, hot ink drys quicker, potentially aiding in print quality and the drying of small fonts. The microwaved ink would therefore dry more efficiently, and higher viscosity inks could be used, became the viscosity would be lowered by heating.

An experiment was conducted to verify the systems and methods according to this invention. An in-line degassing system would need to degas 40 ml/min of ink for ink flow rates of the printer utilized in the experiment. Tap water was used, which was saturated with 7.5 mg/l of $O_2$. The oxygen levels were measured with a dissolved oxygen meter. An ultrasonic degasser was used to degas 40 ml of water for one minute. The ultrasonic degasser was the best system previously used for in-line degassing. After one minute, the dissolved oxygen level was only lowered to 5.5 mg/l. Then, 45 ml of tap water was microwaved for 40 seconds and then placed in a vacuum chamber for 18 seconds. A vacuum pressure of 12 inches of Hg was pulled in the chamber, which was comparable to the vacuum pulled in the ultrasonic degasser. The dissolved oxygen level was lowered from 7.7 mg/l to 2.7 mg/l. This clearly shows that microwave degassing reduces the dissolved oxygen level to acceptable levels in the required time.

While the invention has been described in conjunction with a specific embodiment, it is evident that many alternatives, modifications and variations may be apparent and predictable to those skilled in the art. In particular, the microwave degassing unit according to the invention can be used in any type of printer or system in which ink degassing would be advantageous, or can be used at the manufacturing source to degas the ink prior to packaging. Accordingly, the preferred embodiments as set forth herein are intended to be illustrative, not limiting. Various changes may be made without departing from the spirit and scope of the invention.

What is claimed is:

1. A microwave degassing unit, comprising:

a microwave heater that heats ink in an ink line passing through the microwave heater with microwaves to supersaturate the ink with air; and a vacuum chamber disposed alone the ink line that evacuates the ink to pull the air out of the ink.

2. The microwave degassing unit of claim 1, wherein the unit is provided in an ink handling system of a printer.

3. The microwave degassing unit of claim 2, wherein the printer is an ink jet printer.

4. An ink handling system, comprising:

an ink source;

at least one ink supply line connected to said ink source; and a microwave ink degassing unit disposed along the at least one ink supply line.

5. The system of claim 4, wherein the microwave ink degassing unit comprises a microwave dryer and a vacuum chamber.

6. The system of claim 5, wherein the microwave degassing unit uses a match load of the microwave dryer.

7. The system of claim 4, wherein the system is provided in a printer and the at least one ink supply line is connected to a printhead.

8. The system of claim 7, wherein the printer is a thermal ink jet printer.

9. The system of claim 7, wherein the printer is a multi-color printer having a plurality of ink supply lines, each for a different colored ink.

10. The system of claim 9, further comprising a control system that selectively couples the ink degassing unit onto one or more of the plurality of ink supply lines so that only supply lines of colored ink being currently utilized for printing are degassed.

11. The system of claim 4, further comprising a control system that selectively diverts the at least one ink supply line through the ink degassing unit.

12. The system of claim 4, further comprising a control system that selectively couples the ink degassing unit onto one or more of the at least one ink supply line.

13. A method of degassing ink, comprising:

heating the ink with microwaves to supersaturate the ink with air; and evacuating the ink to pull the air out of the ink.

14. The method of claim 13, wherein the heating and evacuating are performed in an ink handling system of a printer.

15. The method of claim 14, wherein the printer is a thermal ink jet printer.

16. A method of degassing ink for use in a printer, comprising:

selectively diverting at least one ink supply line connected to a printhead through an ink degassing unit;

heating the ink within the diverted at least one ink supply line with microwaves to supersaturate the ink with air; and evacuating the ink to pull the air out of the ink.

17. The method of claim 16, wherein the printer is a multi-color printer having a plurality of ink supply lines, each for a different colored ink, and wherein only the ink supply lines of colored ink being used in a current print job are diverted through the ink degassing unit.

* * * * *